US005320873A

United States Patent [19]

McClain et al.

[11] Patent Number: 5,320,873

[45] Date of Patent: Jun. 14, 1994

[54] PROCESS AND APPARATUS FOR TREATING CELLULOSIC FIBER-CONTAINING FABRIC TO IMPROVE DURABLE PRESS AND SHRINKAGE RESISTANCE

[75] Inventors: David R. McClain, Williamsburg; Ewart H. Shattuck, Cincinnati, both of Ohio

[73] Assignee: American Laundry Machinery, Inc., Cincinnati, Ohio

[21] Appl. No.: 751,981

[22] Filed: Aug. 29, 1991

[51] Int. Cl.[5] ..... B05D 3/02

[52] U.S. Cl. ..... 27/393.2; 427/339; 427/377; 427/255.1; 427/315

[58] Field of Search ..... 427/393.2, 339, 255.1, 427/377, 374.1, 389.9, 392, 315; 8/116

[56] References Cited

U.S. PATENT DOCUMENTS

| | | | |
|---|---|---|---|
| 2,297,230 | 9/1942 | Langen | 427/255.1 |
| 2,833,670 | 5/1958 | Roth | 427/393.2 |
| 3,147,135 | 9/1964 | Brown | 427/255.1 |
| 3,318,722 | 5/1967 | Ullman . | |
| 3,650,801 | 3/1972 | Hinton et al. | 427/393.4 |
| 3,660,013 | 5/1972 | Payet et al. | 8/116.4 |
| 3,706,526 | 12/1972 | Swidler et al. | 8/115.7 |
| 3,712,086 | 1/1973 | Payet et al. | 68/5 C |
| 3,742,904 | 7/1973 | Bishop . | |
| 3,837,799 | 9/1974 | Wilson et al. | 8/115.6 |
| 3,856,558 | 12/1974 | Robbart | 427/255.1 |
| 3,865,545 | 2/1975 | Forg et al. | 8/116 R |
| 3,884,632 | 5/1975 | Payet et al. | 8/116.4 |
| 3,936,542 | 2/1976 | Cox | 427/324 |
| 3,960,482 | 8/1976 | Payet | 8/116.4 |
| 3,960,483 | 6/1976 | Payet | 8/116.4 |
| 4,032,294 | 6/1977 | Thompson et al. | 8/116.4 |
| 4,067,688 | 1/1978 | Payet | 8/116.4 |
| 4,295,847 | 10/1981 | Petersen et al. | 427/393.2 |
| 4,761,305 | 8/1988 | Ochiai . | |

*Primary Examiner*—Shrive Beck
*Assistant Examiner*—D. L. Dudash
*Attorney, Agent, or Firm*—Bacon & Thomas

[57] ABSTRACT

A process and apparatus for treating cellulosic fiber containing fabrics to improve durable press and shrinkage resistance includes using steam as a vehicle to supply vaporized liquid cellulosic cross-linking agent and vaporized liquid catalyst to a reaction chamber in which the fabric articles are treated by cross-linking the cellulose. Normally liquid cross-linking agent and liquid catalysts are directly injected into a stream of treating steam to cause vaporization of the cross-linking agent and catalyst. Alternatively, a steam driven ejector type pump is utilized to entrain and vaporize liquid cross-linking agent and liquid catalyst in a flowing stream of steam supplied to the reaction chamber. Gaseous ammonia may also be supplied to the reaction chamber to condition the cellulosic material containing fabric before cross-linking.

20 Claims, 3 Drawing Sheets

PROCESS AND APPARATUS FOR TREATING CELLULOSIC FIBER-CONTAINING FABRIC TO IMPROVE DURABLE PRESS AND SHRINKAGE RESISTANCE

BACKGROUND OF THE INVENTION

1. Field of the Invention

This invention relates to the treatment of cellulosic fiber-containing fabric and articles made from such fabric with a cross-linking agent in the presence of a catalyst to improve durable press and shrinkage resistance properties of the fabric.

2. Discussion of Related Art

Treatment of cellulosic fibers (e.g., cotton, linen, hemp, rayon, etc.) and blends of fibers including cellulosic fibers with a cross-linking agent such as formaldehyde in the presence of moisture and a catalytic acid producer such as sulphur dioxide to improve the durable press (i.e., crease resistance) and shrinkage properties of fabric and articles made of such fibers is well documented in published literature and well known to those skilled in the art of fiber treatment. The physical chemistry of the process is also well documented and the effect of the cross-linking treatment on cellulosic containing fabric and articles of apparel made from such fabric has been researched and published extensively.

Exemplary prior art processes are described in the patent literature, where previous attempts have resulted in systems that are intended to solve some of the more practical problems of applying cross-linking treatment to finished articles of apparel in a low cost, high volume (i.e., commercial scale) and efficient manner, as well as cross-linking treatment systems generally for cellulosic material.

The problems intended to be solved by the prior art processes and systems are described in the various patents issued to inventors in this field, but this discussion is concerned with prior art systems for treating cellulosic and cellulosic blend fabrics that have been formed into finished articles of apparel on a high volume, continuous production basis to improve the durable press and shrinkage resistance properties of the apparel.

One approach to treating cellulosic fabrics and articles made from such fabrics described in the patent literature involves treating garments in a closed chamber using a gaseous cross-linking agent with steam and a gaseous catalyst, such as is described in U.S. Pat. Nos. 3,660,013 and 3,712,086 issued to G. Payet and J. Forg on May 2, 1972 and Jan. 23, 1973, respectively. This process involved the generation of gaseous phase cross-linking agent by heating powder of solid para-formaldehyde in a chamber containing the garments to be treated and then mixing the gas with steam and a gaseous cross-linking promoting catalyst such as sulphur dioxide in the chamber so that the mixture permeates the garments therein. The temperature in the chamber is then reduced for a period of time and the temperature in the chamber is then increased to the cross-linking temperature of the fabric and cross-linking agent. While successful, this process has drawbacks in that heated trays used to vaporize formaldehyde required constant cleaning and maintenance, the moisture content of the fabric, while critical, was difficult to control, and excess formaldehyde absorbed into the fabric weakened the fabric and required careful cleaning of residual, non-cross-linked formaldehyde from the garments after the cross-linking procedure to avoid undesirable formaldehyde odors and irritant being left on the garments.

In U.S. Pat. No. 3,837,799 issued to K. W. Wilson, R. Swidler and J. P. Gamarra on Sep. 24, 1974, a process is described for crease proofing garments made from cellulosic fiber-containing fabric using gaseous formaldehyde generated by heating para-formaldehyde in mineral oil and subjecting cellulosic fiber-containing fabric with previously applied latent catalyst to the gaseous formaldehyde in a reaction chamber at about 90°-150° C. In this process, two controlled procedures are required to expose the fabric to catalyst and formaldehyde, the process is both temperature and moisture sensitive, and careful cleaning of the formaldehyde and water soluble catalyst from the fabric is required.

U.S. Pat. Nos. 3,960,482 and 3,960,483 issued to G. L. Payet on Jun. 1, 1976 describe a durable press process involving a similar procedure for pre-conditioning fabric with a water soluble catalyst and then subjecting it to formaldehyde vapors and moisture before curing (cross-linking) the fabric and formaldehyde at cross-linking temperatures. The problems of the prior art systems are discussed in this patent, particularly the difficulties encountered in precisely controlling moisture content in the fabric in the presence of a toxic gas and a gaseous catalyst. In accordance with the process described in this patent, the moisture content of the cellulosic fibers is controlled so they have over 20% weight of moisture and contain a selected amount of catalyst when exposed to cross-linking formaldehyde vapor. This enables the process to be carried out at a lower temperature (i.e., room temperature) with a drastically reduced concentration of formaldehyde (6% by volume) as compared with prior art procedures. This process, as with processes previously used, required separate moisture, formaldehyde and catalyst applications to the fabric, and also was highly dependent on the moisture content of the fabric for its successful implementation. The moisture was introduced into the fabric as a spray, mist or fog, or was padded on the fabric alone or with a catalyst. This left the problem of generating the gaseous cross-linking agent and applying it to the fabric in a uniform manner as rapidly as possible. Presumably, the cross-linking formaldehyde vapor used in accordance with the process described in the patent was generated from vaporizing solid form para-formaldehyde, which entailed maintenance problems already discussed above.

U.S. Pat. No. 3,865,545 issued to J. H. Forg and G. L. Payet describes an other process for treating cellulosic fiber articles to impart a durable press thereto involving vaporizing solid para-formaldehyde in a reaction chamber and exposing the fabric articles to the formaldehyde vapors, steam and gaseous catalyst for a period of time at a temperature initially ranging from 120° F. to about 145° F., followed by cooling the fabric 10°-30° by the time of completion of the procedure. Steam and free chemicals are then purged from the chamber before the temperature in the chamber is increased to cross-linking temperature. Steam and fresh air are then circulated over the articles to clean them of residual odors. As in previously described processes, control over moisture content, cross-linking agent concentration and catalyst content in the fabric as well as temperatures are all critical to some degree; vaporization of solid para-formaldehyde is difficult to control precisely; and the formaldehyde vapor generating system is maintenance intensive.

A process for the continuous treatment of continuous fabric and/or garments for improved durable press characteristics is described in U.S. Pat. No. 3,884,632 issued to G. L. Payet and B. D. Brummet on May 20, 1975. In this patented system, the material to be treated was advanced through successive treating stations where it was sequentially moisturized, subjected to formaldehyde (generated by vaporizing solid para-formaldehyde) and catalyst, heated and cross-linked, and cleaned in a continuous process.

U.S. Pat. No. 4,032,294 issued Jun. 28, 1977 to R. D. Thompson, D. Thompson and M. A. Beeley describes a similar process for continuously treating garments using a series of workstations and chambers to process equal sized batches of garments.

U.S. Pat. No. 3,706,526 issued on Dec. 19, 1972 to R. Swidler and K. Wilson describes a durable press process using formaldehyde and sulphur dioxide to treat cellulosic fabrics. Moisture content of the fabric is described as being very important to achieve a self-limiting reaction (cross-linking) but moisture, gaseous formaldehyde and gaseous catalyst are all conveyed to the fabric by different routes and equipment, therefore requiring careful control over the system at all times to maintain proper proportioning of chemicals and moisture reaching the fabric.

U.S. Pat. No. 4,067,688 issued on Jan. 10, 1978 to G. L. Payet describes a durable press process for cellulosic fiber-containing fabrics using formaldehyde vapor and a liquid catalyst (aryl sulfonic liquid or acid) in a high moisture environment. The moisture, formaldehyde and catalyst generally are introduced to the fabric via different routes in the process, requiring careful control over operating parameters.

A known commercial process involves direct injection of a known quantity of liquid formaldehyde cross-linking agent into a stream of steam supplied at a temperature sufficient to vaporize the formaldehyde and then supplying a quantity of the steam with entrained vaporized formaldehyde into a treating chamber wherein a cellulosic containing fabric article has been placed for treatment. A gaseous cross-linking promoting catalyst such as sulfur dioxide is then introduced into the chamber and the fabric article is exposed to the mixture of steam, formaldehyde, and sulfur dioxide for a preselected time The free steam, formaldehyde and sulfur dioxide (not retained by the fabric article) are then purged from the treating chamber and the chamber's temperature is elevated to cross-linking temperature for a sufficient time to cross-link the cellulosic material in the fabric, following which the chamber is cooled and the fabric is removed from the chamber. This process, while facilitating the delivery of formaldehyde to the fabric article to be treated by using a stream of steam as a vehicle, still required close control over the supply of gaseous catalyst, along with all of the gaseous supply tanks, conduits, valves and controls associated with the sulfur dioxide supply system. Inside the treating chamber, the gaseous catalyst moved independently of the steam and vaporized formaldehyde, so experimentation was required to ensure that the appropriate amount of sulfur dioxide gas actually reached the fabric with the cross-linking formaldehyde in a correct manner to ensure good cross-linking results for the particular fabric undergoing treatment. Achieving minimum strength loss in the treated fabric article and low residual free chemicals to be removed from the fabric after completion of the cross-linking process required careful control over the process.

Thus, while the known systems for cross-linking cellulosic containing fabric articles using steam, cross-linking agent and cross-linking promoting catalyst in a treating chamber have achieved some success, problems still remain in terms of processing cost, speed and efficiency, as well as residual chemicals left in the cross-linked fabric. Fabric strength loss resulting from cross-linking and achievement of shrinkage control with acceptable durable press quality remained to be achieved at minimum cost.

BRIEF SUMMARY OF THE INVENTION

The present invention provides improvements in an apparatus and process for treating a cellulosic material containing fabric to improve its shrinkage resistance and durable press properties, wherein steam is used as the vehicle for delivering a cellulosic cross-linking agent to the fabric in a treating chamber in which the cross-linking reaction takes place.

More specifically, this invention provides apparatus for treating a fabric article containing cellulosic material including a treating chamber for receiving a fabric article to be treated, a source of pressurized treating steam and a conduit for carrying the treating steam from the source of treating steam into the treating chamber; an ejector type pump having a suction zone associated with the conduit and arranged to receive treating steam from the conduit for generating suction at the suction zone and to discharge the treating steam into the treating chamber; means for supplying at least a liquid cellulosic cross-linking agent to the suction zone of the pump for entrainment with the treating steam; the treating steam having a temperature sufficiently high to vaporize the cellulosic cross-linking agent upon entrainment of the latter into the treating steam; and a means for supplying a cross-linking promoting catalyst into the treating chamber. This system enables the cellulosic cross-linking agent to be entrained and vaporized in the treating steam at the suction zone of the pump and to be discharged with the treating steam into the treating chamber for treating a fabric article in the treating chamber.

The invention also provides a means for supplying a cross-linking promoting catalyst into the treating chamber by supplying the catalyst in liquid form to the suction zone of the pump for entrainment with the treating steam, and a means for controlling the level of the cross-linking agent at the inlet area of the suction zone of the pump.

The invention furthermore contemplates a method for treating a fabric article as described above including the steps of providing a steam driven ejector type pump in a treating steam conduit and introducing the cross-linking agent into the treating steam by entraining it in liquid form into the steam at the suction zone of the pump, where the cross-linking agent is vaporized and carried into the treating chamber with the treating steam.

The invention furthermore contemplates the step of introducing a cross-linking promoting catalyst into the treating chamber by entraining a normally liquid catalyst into the treating steam at the suction zone of the steam driven ejector type pump, vaporizing the catalyst in the steam and then delivering both the steam and the catalyst to the treating chamber.

Also, in accordance with the invention, both the cross-linking agent and the catalyst may be simultaneously introduced into the treating steam and vaporized therein at the steam driven ejector type pump by supplying a mixture of the liquid cross-linking agent and liquid catalyst to the suction zone of the ejector type pump while it is driven by the treating steam.

The invention also contemplates a process for treating a fabric article as described previously wherein the fabric article is exposed to gaseous ammonia, preferably with steam, in the treating chamber before the cellulosic material is cross-linked.

This invention also contemplates a process for treating a fabric article as described previously wherein the cellulosic cross-linking agent and the cross-linking promoting catalyst are introduced into the treating chamber by directly injecting the cross-linking agent and catalyst into the treating steam that is supplied to the chamber, following which the normal cross-linking process is carried out. In accordance with this process, the cross-linking agent and catalyst may be supplied to the steam independently or simultaneously by mixing them together before injection into the steam, and the steam is supplied at a temperature above the vaporization temperature of the cross-linking agent and catalyst.

The invention furthermore contemplates utilizing specific liquid cross-linking agents and cross-linking promoting catalysts as described herein.

BRIEF DESCRIPTION OF THE DRAWINGS

The present invention, including its characteristics and features, as well as preferred embodiments thereof, will be described in more detail in connection with the appended drawings wherein.

DETAILED DESCRIPTION OF THE PREFERRED EMBODIMENTS OF THE INVENTION

Figure 1:
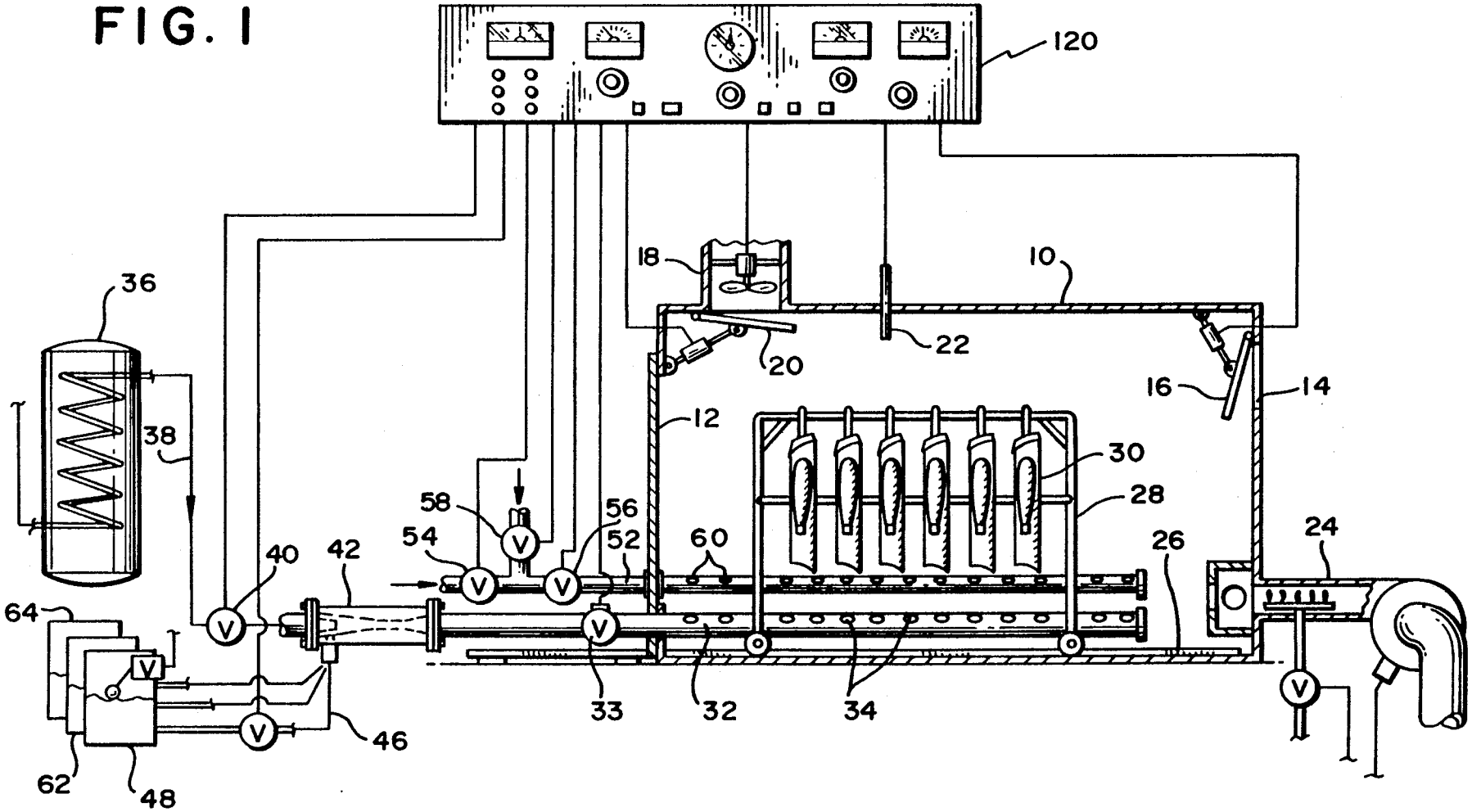
FIG. 1 is a schematic illustration of one embodiment of apparatus utilized for carrying out the invention including a steam driven ejector type pump.

With reference to FIG. 1, apparatus embodying this invention for treating one or more fabric articles containing cellulosic material to improve the shrink resistance properties of the fabric articles during laundering and to improve the durable press properties of the fabric articles includes a reaction or treating chamber 10 having a door 12 for loading fabric articles into the chamber, a fresh air inlet 14 having a controllable closure 16 and an exhaust vent 18 having a controllable closure 20. A temperature probe 22 and a heater 24 are also connected to the chamber. Rails 26 are provided on the floor of the chamber for supporting and guiding a cart 28 arranged to carry finished fabric articles 30 into and out of the chamber 10 through door 12.

A first conduit 32 is provided near the bottom of the treating chamber 10 and includes openings 34 for providing communication between the interior of the conduit 32 and the interior of the chamber 10. A control valve 33 is provided to control flow through conduit 32. Conduit 32 is connected to a source 36 of treating steam under pressure via a steam conduit 38 and a control valve 40 as seen at the left of FIG. 1. A steam driven ejector type pump 42 is provided between the steam conduit 38 and the conduit 32 for entraining a liquid chemical into a stream of treating steam supplied to the pump 42 and discharged into the conduit 32.

Figure 3:
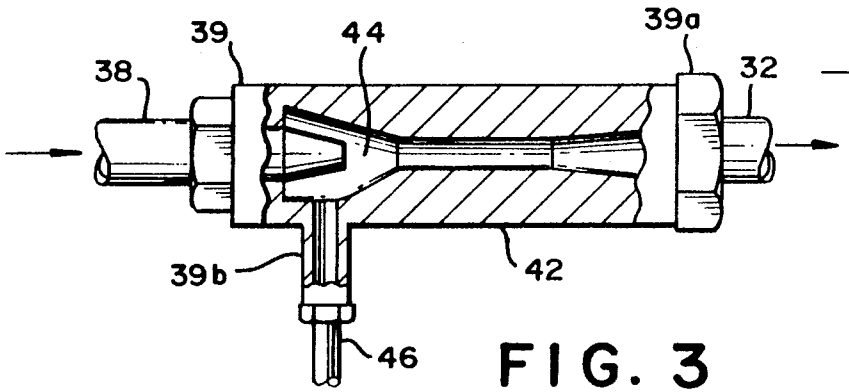
FIG. 3 shows a detail of an ejector type pump utilized in FIG. 1.

A preferred embodiment of an ejector type pump useful in carrying out the process in accordance with this invention is shown in more detail in FIG. 3, and includes an inlet end 39 connected to steam conduit 38 and an outlet end **39*a* connected to the conduit 32. The pump includes a low pressure suction zone 44 created by the accelerated flow of pressurized steam through the suction zone in accordance with well-known principles. The pump includes an inlet 39*b* for fluid to be pumped by the action of the driving steam, with the inlet 39*b* connected to a supply conduit 46 for fluid supplied to the suction zone 44 of the pump. In accordance with well-known principles of operation involving ejector type pumps, the supply of pressurized steam to the inlet end 39 of pump 42 produces a suction at the suction zone 44 which will pump fluid (in this case liquid) through the supply conduit 46 by entraining and mixing the driving steam and pumped fluid together. The mixture is discharged through the outlet end 39*a* of the pump and flows through conduit 32 eventually into the treating chamber 10**.

Figure 4:
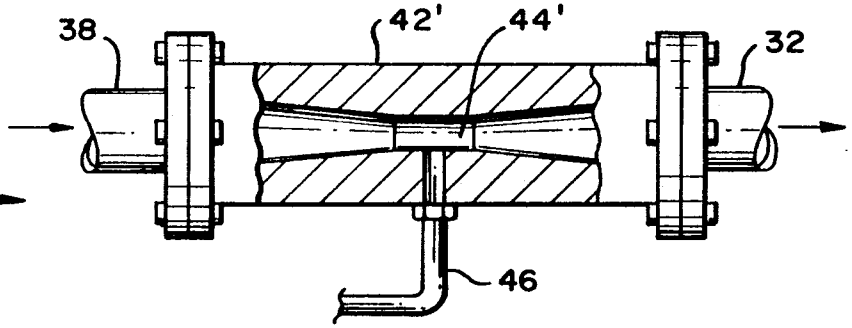
FIG. 4, shows a detail of an alternative ejector type pump useful in the FIG. 1 embodiment.

In FIG. 4, an alternate embodiment of an ejector type pump 42' is illustrated and includes a venturi suction zone 44' connected to a supply tube 46 for liquid to be pumped with the steam. The embodiment of ejector type pump illustrated in FIG. 4 operates in the same manner as the pump illustrated in FIG. 3; specifically, pressurized steam supplied through conduit 38 is accelerated as it passes through the suction zone 44' of the pump creating a low pressure for pumping fluid through supply tube 46.

In accordance with this invention, steam supplied through conduit 38 is maintained at a temperature at or above the vaporization temperature of liquid supplied through supply tube 46 so that the mixture discharged from the steam driven pump is in vapor form. It is to be understood that the term "ejector type pump ejector pump" is intended to broadly encompass any fluid driven pump arrangement wherein suction is created by a change in the velocity or pressure of pumping or driving fluid at a suction zone and wherein a fluid to be pumped is supplied to the suction zone. In all instances it is intended that the driving and pumped fluids will be mixed in a pump of this type.

The liquid chemical supply tube 46 is connected at its outlet end to the suction zone 44 of the pump 42 and at its other end is connected to a supply 48 of liquid chemical to be entrained in the treating steam. A valve 50 is provided to control the flow of liquid chemical into the supply tube 46. The supply source 48 in its simplest embodiment may comprise a tank having an inlet valve that is controlled by a float that senses liquid level of chemical in the tank and maintains the chemical in the tank at a predetermined selected level that will maintain a liquid level in the supply tube 46. The liquid level in the supply tube 46, of course, determines the rate at which liquid chemical will be taken up at the suction zone 44 of the pump 42 in accordance with well-known principles. It is to be understood that any suitable arrangement could be provided to secure the maintenance of a predetermined liquid level of chemical in the supply tube 46 to control the rate at which the liquid chemical will be entrained in the moving stream of steam driving pump 42.

Operation of the system described thus far is as follows. The door to treating chamber 10 is opened and a cart 28 with fabric articles such as finished garments made of fabric containing a cellulosic material is wheeled into the chamber on the rails 26. The door 12 is closed and the closures 16 and 20 are closed. Pressurized steam from source 36 is then driven through the pump 42 and into chamber 10 via conduit 32. The initial steam supplied to the chamber 10 may or may not contain any liquid chemical supplied through tube 46 at the pump 42, depending upon whether it is desired to introduce the liquid chemical into the chamber 10 at this point or merely to provide moisture to the fabric articles 30. At the desired time, valve 50 is opened and liquid chemical is supplied to the tube 46 and entrained in the driving stream of steam passing through pump 42 into the conduit 32 and ultimately into the chamber 10. The temperature of the steam moving through the pump 42 is maintained at a suitable level to ensure that the liquid chemical introduced through the tube 46 will vaporize as it is entrained in the steam and before it enters the treating chamber 10. The fabric articles 30 thus will be exposed to a uniform mixture of steam and liquid treating chemical within the treating chamber 10 as the steam and chemical condense on the fabric of the articles 30.

In accordance with this invention, it is desired to introduce liquid cellulosic cross-linking agent as a liquid chemical introduced to the supply tube 46 at connected to pump 42. In this manner, a liquid cross-linking agent can be supplied with the treating steam supplied to the chamber 10 in a manner that is self-regulating, as determined by the level of liquid cross-linking agent maintained in supply tube 46 and the suction capacity of the ejector type pump 42. More specifically, the use of the ejector type pump 42 enables the used of a minimum amount of cross-linking agent required to carry out the cross-linking of the cellulosic material in the fabric articles 30. The only major controls required are the pressure and temperature of the treating steam, the level at which the steam can generate suction at the pump suction zone, the liquid level of cross-linking agent in the supply tube 46, and the rime of injection of the steam to ensure that the fabric articles 30 are exposed to a desired quantity of steam and cross-linking agent.

Various arrangements can be used to introduce a cross-linking promoting catalyst into the treating chamber 10. In accordance with one preferred embodiment of such apparatus, a gaseous catalyst may be supplied to a second conduit 52 under the control of appropriate valves 54, 56 and/or 58. Second conduit 52 includes openings 60 to provide communication between the interior of second conduit 52 and the interior of treating chamber 10. Thus, at an appropriate point during the treating process, one or more valves 54, 56 or 58 are suitably controlled so as to provide communication between second conduit 52 and a source of cellulosic cross-linking promoting catalyst in gaseous form so that the gaseous catalyst is introduced into the interior of chamber 10 with the steam and cellulosic cross-linking agent that has been supplied through conduit 32.

In accordance with known methodology, the fabric articles 30 are exposed to a known concentration of steam, cross-linking agent and catalyst for a predetermined time interval, following which the chamber is purged by opening the closures 16, 20 and the chamber is ventilated by operating an exhaust fan in the exhaust vent 18. Following the ventilation of the chamber 10, the closures 16 and 20 are closed and the temperature in the chamber is elevated by activating the heater 24 until the chamber reaches a desired cross-linking temperature depending upon the fabric articles 30 and the cross-linking agent and catalyst used in the process. Following cross-linking, the temperature in the chamber is lowered and the finished articles 30 are removed from the chamber through the door 12.

Beneficial results can be obtained by utilizing the ejector type pump 42 to entrain a normally liquid cross-linking promoting catalyst into the driving steam supplied through conduit 32 to the chamber 10. In this embodiment, a mixture of liquid cross-linking agent and liquid catalyst appropriate for the cross-linking agent is provided in the supply source tank 48 and is supplied to the pump 42 through supply tube 46, in the same manner as the cross-linking agent alone was supplied in the embodiment described above. Thus, both cross-linking agent and catalyst in liquid form can be drawn into and vaporized in the stream of steam moving through pump 42 at its suction zone 44 and then supplied as a mixture of steam, cross-linking agent and catalyst to the interior of the chamber 10 for use in the above-described cross-linking process.

In still another embodiment, the liquid catalyst can be supplied through tube 46 from a separate supply tank 62 or a separate steam driven ejector type pump (not illustrated) could be provided for entraining liquid catalyst into a stream of steam carried by conduit 32 or by a separate conduit (not illustrated) having openings for providing communication between the separate conduit and the interior of the chamber 10.

In any of the embodiments thus far discussed, still another liquid chemical supply tank 64 can be provided to supply liquid chemical to the stream of steam carried by conduit 32 through pump 42 or another ejector type pump driven by a stream of pressurized steam that is then supplied to the interior of the treating chamber 10. The ejector type pump thus provides a simple expedient for entraining liquid chemical into a stream of steam supplied to the interior of treating chamber 10. Since the steam temperature will be maintained above the vaporization temperature of the liquid chemical, the liquid chemical will be vaporized in the treating steam, so that virtually no controls are required within the chamber 10 to ensure that the fabric articles 30 are uniformly exposed to a mixture of steam and the chemical entrained in the steam.

In accordance with another embodiment of the invention, gaseous ammonia can be supplied to the interior of treating chamber 10 to further condition the fabric articles 30 during the treating process. The gaseous ammonia may be supplied through conduit 52 or may be supplied through the conduit 32 with treating steam. The process utilizing ammonia will be described in more detail below.

Figure 2:
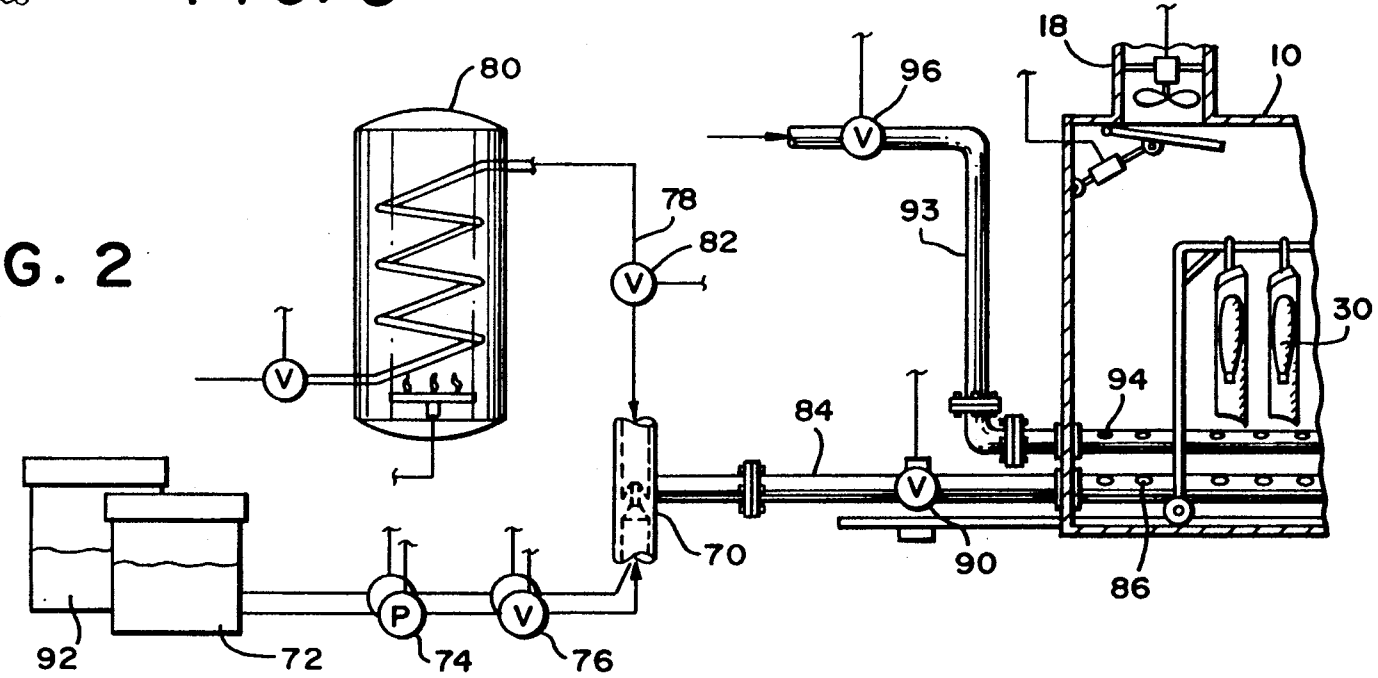
FIG. 2 is a similar schematic illustration of the invention wherein liquid cross-linking and catalyst chemicals are directly injected into a stream of treating steam.

With reference to FIG. 2, apparatus for introducing steam and liquid chemical includes a direct injector 70 arranged to inject liquid chemical under pressure from a supply tank 72. An appropriate pump 74 and control valve 76 provide a pressurized supply of liquid chemical to the injector 70 for direct injection of the liquid chemical into a flowing stream of steam supplied through conduit 78 connected to a source of steam 80. An appropriate valve 82 controls the flow of steam through conduit 78, which in turn is connected to a supply conduit 84 that corresponds to supply conduit 32 in the embodiment of FIG. 1. Thus, the conduit 84 includes openings 86 that provide communication between the conduit 84 and the interior of treating chamber 10, which otherwise corresponds with the treating chamber 10 illustrated in FIG. 1.

Preferably, the direct injector 70 is arranged to cause direct head-to-head impingement of a stream of steam flowing into conduit 84 and liquid chemical supplied to the injector 70.

In accordance with this embodiment, a stream of treating steam under pressure is supplied from source 80 through conduit 78 and conduit 84 under the control of valves 82 and 90. At an appropriate time, liquid chemical from tank 72 and delivered by pump 74 is supplied to the injector 70 for direct injection into the moving stream of steam supplied through conduit 78. The liquid chemical is entrained in the moving stream of steam supplied to the conduit 84 and ultimately is discharged into the interior of treating chamber 10 to provide an atmosphere in the chamber suitable for carrying out the fabric treating process outlined above. The temperature of the steam supplied through conduit 78 is maintained at a suitable level to ensure vaporization of the liquid chemical supplied through the injector 70 so that the chemical is uniformly distributed throughout the interior of the chamber 10 with the steam supplied through conduit 84.

In accordance with this embodiment, a liquid cellulosic cross-linking agent is supplied through the injector 70 for entrainment in the stream of treating steam supplied through conduit 84. In addition, a liquid cross-linking promoting catalyst can be supplied by mixing the catalyst with the cross-linking agent in the tank 72 and supplying the mixture to the injector 70. In accordance with this arrangement, the steam, cross-linking agent and catalyst will be supplied as a mixture to treating chamber 10 via conduit 84. Alternatively, the liquid catalyst may be supplied through a separate tank 92 connected to the injector 70 through an appropriate conduit means incorporating suitable valving and pumping means. If desired, still other tanks (not illustrated) could be connected to the injector 70 in conjunction with suitable pumps and valving arrangements so that additional liquid chemicals can be injected directly into the stream of treating steam supplied through conduit 78 and introduced to the chamber 10 through conduit 84.

A second conduit 93 including openings 94 is provided to supply other chemical treating agents to the interior of treating chamber 10 under the control of valve 96. The second conduit 93 normally will supply a gaseous treating agent, such as a liquid cross-linking promoting catalyst, ammonia, or other desired agents to the interior of treating chamber 10 as part of the fabric treating.

Figure 5:
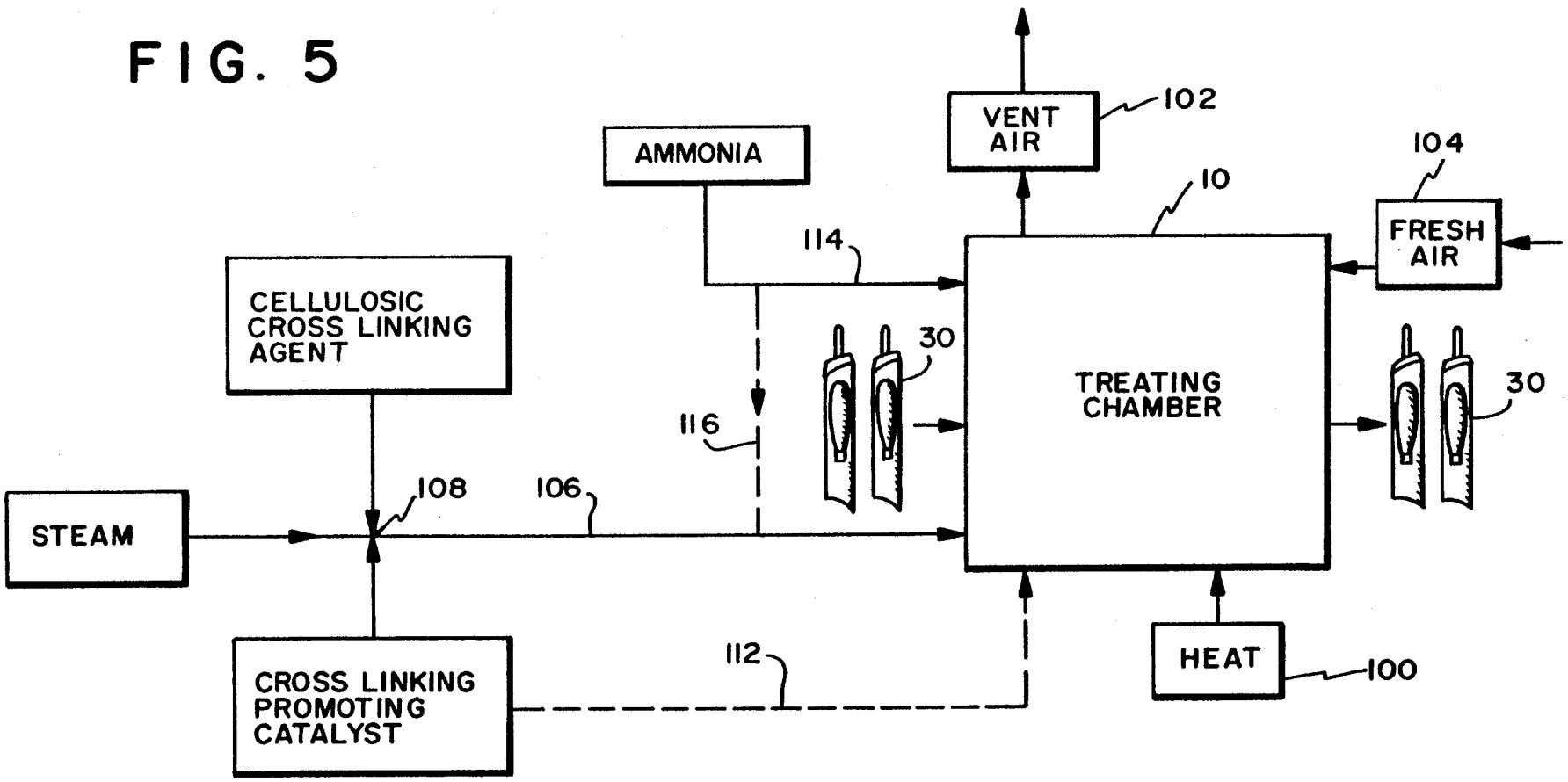
FIG. 5 schematically illustrates a flowchart depicting the processes embodying the invention.

In FIG. 5 there is illustrated a flowchart for carrying out cross-linking of cellulosic material containing fabric articles 30 in chamber 10 in accordance with this invention. As illustrated, chamber 10 is in communication with a source of heat 100, and includes an exhaust vent 102 and a fresh air vent 104. Fabric articles containing cellulosic material such as garments 30 are periodically placed in the treating chamber 10 where an atmosphere of steam, vaporized cellulosic cross-linking agent, and vaporized or gaseous catalyst is provided. The vaporized cellulosic cross-linking agent will be supplied as a liquid that has been vaporized and entrained in a quantity of treating steam supplied through conduit 106 by direct injection or by entrainment at the suction zone of an ejector type pump provided at point 108 along the conduit 106. The vaporized or gaseous cross-linking catalyst will be supplied as a liquid directly injected into the treating steam in conduit 106 at point 108, a liquid entrained at the suction zone of an ejector type pump provided at point 108, or as a gas supplied via conduit 112. If desired, the ammonia in gaseous form may be supplied either directly to the interior of treating chamber 10 via conduit 114 or may be injected into the treating steam via conduit 116 before the cross-linking is carried out, preferably before the fabric articles are exposed to the cross-linking agent and catalyst.

After the fabric articles 30 are exposed to the cellulosic cross-linking agent, catalyst and steam in the chamber 10, cross-linking is carried out at a cross-linking temperature in accordance with the procedure described previously. Finished fabric articles 30 are then removed from the treating chamber for further processing and distribution.

A central control panel 120 preferably incorporating a microprocessor is connected by appropriate leads to the various actuators, pumps, valves, temperature probe, heater and blower utilized in the system illustrated in FIG. 1. The central control panel enables an operator to observe operation of the entire system. For example, opening and closing of the closures 16 and 20 as well as operation of the vent fan and the exhaust vent 18 can be operated at the proper time under the control of a microprocessor associated with the control panel 120 and the operation of the heater 24, including its associated gas supply valve and blower likewise can be controlled for proper operation to control the temperature within the chamber 10. A temperature sensor probe 22 enables sensing of the temperature within the chamber 10 and various other sensors (not illustrated) can be utilized as well to monitor the interior of the reaction chamber 10. The time interval for delivery of treating steam through conduit 24 can be controlled through the control panel 120 by controlling the opening and closing of valves associated with the steam supply conduit 32 and the ejector type 42. The flow and the timing of flow of gaseous chemicals through conduit 52 likewise can be controlled via the control panel 120 by controlling the opening and closing of associated valves 54, 56 and 58. Preferably, the various control valves are electrically actuated, as are the various pump motors and blower motors utilized in the system. It will be understood that any suitable control panel arrangement could be utilized in accordance with well known and accepted procedures and standards in the industry and in a manner that will be apparent to persons skilled in the art of chemical processing. Likewise, the microprocessor contemplated for use in connection with the control panel 120 can be a typical personal computer type microprocessor containing program instructions convertible into electrical signals for controlling the various equipment associated with the apparatus illustrated in FIG. 1.

Examples of the results obtained are described below.

EXAMPLE 1

Samples of U.S. Testing Cotton Twill, U.S. Testing 80 Square Cotton and Cotton Jersey measuring approximately 18 in.×24 in. were subjected to a single household laundering cycle (warm wash, cool rinse) and a permanent press drying cycle. The samples were tested for shrinkage (i.e., the washed sample dimensions were compared with the dimensions before washing) and then washed four more times. After the fifth wash cycle, shrinkage was measured again. Shrinkage was measured lengthwise (L) and widthwise (W) of the fabric samples and shrinkage was determined as a percentile of the original fabric dimensions.

In addition, the durable press properties of the twill and 80 Square samples were measured by the American Association of Textile Colorists and Chemists Test Procedure No. AATCC Test Method 124-1984: "Appearance of Durable Press Fabrics After Repeated Home Laundering." Essentially, the samples were laundered as described above and dried using standard home laundry equipment with a durable press (permanent press) cycle. The samples were then permitted to relax for a predetermined period of time and their surface appearances were compared with a chart, yielding a durable press rating (DP) of 1 to 5, with 5 being the highest rating. The results were as follows:

TABLE 1

| Fabric | Shrinkage (%) L | Shrinkage (%) W | DP |
|---|---|---|---|
| A. Single Wash Cycle | | | |
| Twill | 9 | 1 | 1 |
| 80 Square | 5 | 4 | 1 |
| Jersey | 7.5 | 7.5 | — |
| B. Five Wash Cycles: | | | |
| Twill | 11 | 0 | 1 |
| 80 Square | 7.5 | 7.5 | 1 |
| Jersey | 11 | 6 | — |

Similar samples of the same fabric described above were then placed in a stainless steel reaction chamber as described in FIG. 1 herein, the chamber measuring approximately 6 feet wide by 10 feet long by 7 feet high. Access to the chamber was through an entry door in one end of the chamber and two steam conduits with openings along their lengths extended along the lower sides of the chamber sidewalls. An additional conduit with discharge ports extended the length of the chamber for supplying a gaseous chemical to the interior of the chamber. A direct injector as described above with reference to FIG. 2 for injecting liquid chemical directly into a stream of steam was provided so that steam and entrained vaporized chemical could be supplied into the chamber 10 via the steam supply conduit. The reaction chamber also included various accessories for enabling carrying out a cellulosic cross-linking process, including fresh air inlet and outlet vents with controllable closures, an air blowing fan for ventilation of the chamber, an open combustion gas heater and a hot air circulation system for heating the chamber interior. Also provided were a supply tank for liquid cellulosic cross-linking agent, a pump and conduit system for supplying cross-linking agent to the injector, a steam supply source at 17 psi connected to the injector and the steam conduit in the reaction chamber, and a conduit for gaseous chemical to be supplied into the reaction chamber. The central control panel was wired to the pump, fan, air inlet and outlet closures, as well as various solenoid operated flow control valves provided in the liquid cross-linking agent, steam and gaseous chemical supply conduits. A microprocessor incorporated in the control panel was programmed to control timing of various portions of the treatment cycles to be carried out in the chamber, as well as the timing of flow of steam and chemicals. The liquid cross-linking agent supply tank was calibrated to provide a measuring system for indicating quantity of chemical solutions supplied to the injector. Specifically, a translucent tank was provided with volume graduations in English unit increments (i.e., feet-inches) and, through calibration tests, it was determined that the tank held 0.36 gallons of chemical per inch of vertical height of the tank (approximately 1.36 liters/inch or 0.54 liters/cm.) With the chamber sealed, and using liquid formaldehyde as the cellulosic cross-linking agent, steam at 17 psi and at approximately 220° F. was supplied to the chamber through the injector and steam conduit for 1.5 minutes, while 2400 grams of liquid formaldehyde were injected and entrained in the steam at the injector. 15 lbs. of sulfur dioxide gas was then injected into the chamber through the gaseous chemical supply conduit. After a soak period of 2 minutes, the free cross-linking agent and catalyst not retained on the fabric samples, along with free steam and moisture, were vented from the chamber and the chamber was sealed again. The temperature in the chamber was raised to 260° F. to cross-link the samples are then steam at 60 psi was injected into the chamber for five minutes to clean residual formaldehyde from the samples. The chamber was then vented and cooled and the samples were removed.

Following removal of the samples, they were washed in the same manner as the control samples and tested for shrinkage, strength loss, durable press properties and residual unreacted formaldehyde (expressed as parts per million or ppm) remaining in the samples. Strength Loss lengthwise (L) and widthwise (W) was measured by using a standard ball burst tester (Mullen tester) except for the jersey knit, where strength loss was determined in a single ball type burst test. The results were as follows:

TABLE 2

| Fabric | Shrinkage (%)* L | Shrinkage (%)* W | Strength Loss (%) L | Strength Loss (%) W | DP | PPM Residual |
|---|---|---|---|---|---|---|
| Twill | 4 | 0 | 39 | 41 | 3 | 374 |
| 80 Square | 1 | 1 | 57 | 53 | 3 | 517 |
| Jersey | 2.5 | 2.5 | 39 | | | 538 |

*Shrinkage Measured after single wash cycle

This test indicated that the process used met or exceeded commercial specifications for shrinkage control and durable press for the samples.

Similar samples of twill, 80 square and jersey cotton fabric were then subjected to the identical process described above, except that an ejector type pump Series 270-SYP (¾ in.) supplied by Fox Valve Development Corp. of Dover, N.J. was used in the steam supply conduit to entrain the liquid formaldehyde instead of the direct injector. This ejector pump was similar to the one shown in FIG. 3. Steam was supplied at 50 psi and approximately 275° F. to the ejector type pump and liquid formaldehyde was supplied through a supply tube to the suction zone of the pump, resulting in the entrainment and vaporization of liquid formaldehyde cross-linking agent with the steam that was supplied to the interior of the reaction chamber. In this test, the pump capacity and the level of liquid formaldehyde were set so that 400 grams of liquid formaldehyde was supplied to the suction zone of the pump while driving and treating steam was supplied to the chamber via the pump for a period of 3 minutes. Following soak, venting, cross-linking and steam cleaning operations as described previously, the samples were removed from the chamber and tested for shrinkage, strength loss, durable press properties and residual formaldehyde (PPM). The results were as follows:

TABLE 3

| Fabric | Shrinkage (%)* L | Shrinkage (%)* W | Strength Loss (%) L | Strength Loss (%) W | DP | PPM Residual |
|---|---|---|---|---|---|---|
| Twill | 7.5 | 0 | 0 | 21 | 2 | 76 |
| 80 Square | 4 | 2.5 | 10 | 0 | 2 | 93.5 |
| Jersey | 4 | 0 | 11 | | — | 114 |

*Shrinkage Measured after single wash cycle

This test showed that the use of the ejector pump enabled the achievement of improved strength loss, substantially reduced free formaldehyde in the finished treated samples, with some sacrifice in shrinkage resistance and durable press quality. Most importantly, the quantity of cross-linking agent consumed was substantially reduced.

Other test runs were made using similar fabric samples with the same cross-linking process steps, but with increasing amounts of liquid formaldehyde entrained at the ejector type pump. The properties of the treated fabric samples were observed as follows:

TABLE 4

| Fabric | Shrinkage (%)* L | Shrinkage (%)* W | Strength Loss (%) L | Strength Loss (%) W | DP | PPM Residual |
|---|---|---|---|---|---|---|
| A. Quantity of Formaldehyde: 1020 gms. | | | | | | |
| Twill | 5 | 0 | 3 | 34 | 2.5 | 128 |
| 80 Square | 2.5 | 2.5 | 23 | 23 | 1 | 219.5 |
| Jersey | 1 | 2.5 | 19 | | — | 187 |
| B. Quantity of Formaldehyde: 2000 gms. | | | | | | |
| Twill | 5 | 0 | 0 | 35 | 2.5 | 209.5 |
| 80 Square | 1 | 1 | 10 | 29 | 2.5 | 275 |
| Jersey | 1 | 4 | 28 | | 1 | 256 |

*Shrinkage measured after single wash cycle

From the above tests, it is evident that acceptable shrinkage, strength loss, durable press and residual formaldehyde properties can be achieved using a steam driven ejector type pump for entraining and vaporizing liquid formaldehyde cellulosic cross-linking agent in a stream of steam used to drive the pump, and that the amount of formaldehyde required for cross-linking, as compared with the amount used with the direct injector system to achieve comparable results, can be substantially decreased.

EXAMPLE 2

Samples of cotton Twill, 80 square and jersey as described in Example 1 were subjected to a cross-linking process corresponding to the process described in Example 1 using a direct injector similar to that illustrated in FIG. 2 for entraining liquid formaldehyde cross-linking agent into a stream of treating steam discharged into the reaction chamber similar to the chamber described in Example 1, except that gaseous ammonia with steam was injected into the chamber and the samples were exposed to the ammonia gas and steam for a brief period of time (usually one to two minutes) before the cross-linking agent was discharged into the reaction chamber to initiate the cross-linking process. The ammonia was vented out of the chamber before the cross-linking agent was discharged into the chamber. Table 2 above shows the results observed of the basic cross-linking process in terms of fabric shrinkage and strength loss for the fabric samples. Using the ammonia pretreatment and the same basic process, the following properties were observed in relationship to varying amounts of ammonia discharged into the chamber before the cross-linking process was initiated:

TABLE 5

| Fabric | Shrinkage (%)* L | Shrinkage (%)* W | Strength Loss (%) L | Strength Loss (%) W |
|---|---|---|---|---|
| A. 30 lbs. $NH_3$: | | | | |
| Twill | 5 | 0 | 12 | 54 |
| 80 Square | 1 | 2.5 | 44 | 19.5 |
| Jersey | 4 | 2.5 | 42 | |
| B. 40 lbs. $NH_3$: | | | | |
| Twill | 5 | 0 | 15 | 35 |
| 80 Square | 1 | 1.5 | 63 | 49.5 |
| Jersey | 4 | 2.5 | 43 | |
| C. 50 lbs. $NH_3$: | | | | |
| Twill | 5 | 0 | 2 | 38 |
| 80 Square | 1 | 2.5 | 40 | 54 |
| Jersey | 4 | 2.5 | 35 | |

*All shrinkage measurements were made after five wash cycles

It will be seen that pretreatment of the fabric samples with ammonia did not adversely affect shrinkage resistance of the fabric samples beyond limits of acceptability, yet improved strength loss in one sample or another depending upon the specific concentration of ammonia to which the fabric samples were exposed. This was surprising since the ammonia was caustic and increased the pH of the fabric samples, while the prior art experience and literature up to now suggested that the fabrics should be acidic (pH below 7) for good cross-linking using formaldehyde as the cross-linking agent.

EXAMPLE 3

Fabric samples similar to samples used in Example 1 were cross-linked in a reaction chamber using a process similar to that described in Example 1, but wherein liquid cellulosic cross-linking agent and liquid cross-linking promoting catalyst were premixed in a supply tank and then directly injected into and vaporized in a stream of treating steam at 17 psi using an ejector similar to the ejector 70 described in FIG. 2. The steam and vaporized mixture was then supplied to the reaction chamber. Following a soak period, the free chemicals were vented from the chamber and the chamber was heated to a cross-linking temperature suitable for the particular cross-linking agent and catalyst used. The following tests were made using different cross-linking and catalyst mixtures.

Test 1.

A solution of 600 gms of liquid PROTOREZ, a commercially available liquid cellulosic cross-linking agent manufactured by National Starch and Chemical Company of Salisbury, N.C. 28145, 120 gms of CURITE, a commercially available liquid cross-linking promoting catalyst also made by National Starch Chemical Company, and 2,280 gms of water were added to 14,400 gms of a mixture of liquid formaldehyde (37% formaldehyde, 1.5% methanol and the balance water) and Cat No. 9, an industry standard liquid catalyst comprising a solution of magnesium chloride (the mixture of formaldehyde and CAT#9 was originally mixed using 30,400 gms of formaldehyde and 5,526 gms of Cat. No. 9), and this mixture was directly injected into a stream of treating steam at 17 psi that was supplied for a duration of two minutes into the reaction chamber. The total mixture of the liquid mixture used during injection was 3,200 gms. Cross-linking was carried out by heating the reaction chamber to 320° F. and the samples were then steam cleaned by using 60 psi steam for five minutes. The shrinkage and strength loss tests showed the following results:

TABLE 7

| Fabric | Shrinkage (%)* L | Shrinkage (%)* W | Strength Loss (%) L | Strength Loss (%) W |
|---|---|---|---|---|
| Twill | 5 | 0 | 0 | 10 |
| 80 Square | not tested | | | |
| Jersey | 5 | 1 | 13 | |

*single wash cycle

Test 2.

A solution of 2,000 gms of liquid formaldehyde as described above and 3,600 gms of Cat. No. 9 was directly injected into a stream of 17 psi treating steam supplied to the interior of the reaction chamber for 1½ minutes which resulted in a discharge of 2,400 gms of formaldehyde and catalyst mixture in the reaction chamber. Cross-linking was carried out in the chamber at 340° F. after the samples were soaked in the steam, cross-linking agent and catalyst atmosphere for two minutes followed by evacuation of the chemicals in the chamber. After steam cleaning for five minutes using steam at 60 psi, the samples were tested for shrinkage and strength loss, with the following results.

TABLE 8

| Fabric | Shrinkage (%)* L | Shrinkage (%)* W | Strength Loss (%) L | Strength Loss (%) W |
|---|---|---|---|---|
| Twill | 7.5 | 0 | 0 | 21 |
| 80 Square | 7 | 2.5 | 7 | 0 |
| Jersey | not tested | | | |

*single wash cycle

Test 3.

A mixture of 12,000 gms of formaldehyde as described above and 2,160 gms of SEQUA No. 531, a liquid catalyst available from Sequa Chemicals Inc. of Chester, S.C. 29706-0070 was directly injected into treating steam at 17 psi flowing into the reaction chamber for three minutes, delivering 4,800 gms of the vaporized cross-linking agent and catalyst mixture into the chamber. After a soak period of two minutes, the chamber was vented and cross-linking was carried out by heating the chamber to 320° F. The samples were cleaned using steam at 60 psi for five minutes and the chamber was cooled. After removal of the samples, they were tested for shrinkage and strength loss with the following results:

TABLE 9

| Fabric | Shrinkage (%)* L | Shrinkage (%)* W | Strength Loss (%) L | Strength Loss (%) W |
|---|---|---|---|---|
| Twill | 7 | 0 | 0 | 21 |
| 80 Square | 2.5 | 2.5 | 11 | 22 |
| Jersey | 9 | 1 | 9 | |

*Single Wash cycle

Test 4.

A mixture of 16,000 gms of water, 1,280 gms of GRANATHANE, a liquid cellulosic cross-linking agent manufactured by Grant Industries of Elmwood, N.J. 07407 and 480 gms of Gransil, a liquid catalyst also manufactured by Grant Industries, was directly injected into 17 psi of steam that was permitted to flow into the reaction chamber for 1.5 minutes, delivering 2,400 gms of mixture to the reaction chamber with the steam. The samples were exposed in this atmosphere for two minutes, the atmosphere was purged, the chamber was heated to 260° F., repurged, and then reheated to 350° F. Upon cooling, the samples were removed and tested for shrinkage and strength loss, with the following results observed:

TABLE 10

| Fabric | Shrinkage (%)* L | Shrinkage (%)* W | Strength Loss (%) L | Strength Loss (%) W |
|---|---|---|---|---|
| Twill | not tested | | | |
| 80 Square | 2.5 | 1 | 0 | 0 |
| Jersey | 7.5 | 1 | 19 | |

*single wash cycle

From the series of tests described above, it is clear that a mixture of liquid cross-linking agent with liquid catalyst can be supplied by direct injection into a reaction chamber in a cellulosic cross-linking process using steam as the vehicle. The use of such a mixture results in a reduction of process controls, plumbing, gas supply apparatus and proportioning or metering equipment as compared with a process using a gaseous catalyst. Notably, using liquid catalyst instead of sulfur dioxide gas was observed to produce less color changes in dyed fabrics.

It will be understood that various modifications to the apparatus and process described herein can be made by those skilled in the art without departing from the spirit and scope of the invention, which is defined in the claims below.

We claim:

1. In a method of treating a fabric article containing a cellulosic material to provide controlled shrinkage during laundering and durable press properties for the fabric article including placing the fabric article in a treating chamber, introducing into the chamber a quantity of treating steam containing a vapor of cellulosic material cross-linking agent and a quantity of cross-linking promoting catalyst, and cross-linking the cellulosic material exposed to the steam, cross-linking agent and catalyst in the treating chamber by heating the cellulosic material to a cross-linking temperature for the cellulosic material, the improvement comprising:

providing a steam conduit for supplying steam to the treating chamber and an ejector pump in said steam conduit, said pump having a treating steam actuated suction zone and an inlet to the suction zone;

supplying a stream of steam under sufficient pressure to said pump to produce suction at said pump suction zone and at a temperature above the vaporization temperature of the cross-linking agent;

supplying liquid cellulosic material cross-linking agent to the suction zone inlet of said pump;

said step of introducing treating steam containing a vapor of cellulosic material cross-linking agent into the treating chamber including entraining liquid cellulosic material cross-linking agent into the treating steam at the suction zone at said pump and vaporizing the cross-linking agent upon its entrainment into the treating steam, and distributing the steam and vaporized cross-linking agent throughout the treating chamber to cause its condensation on the cellulosic material in the chamber in sufficient quantity to enable cross-linking of the cellulosic material when the cellulosic material, cross-linking agent and catalyst are heated to cellulosic material cross-linking temperature.

2. The method according to claim 1, including the step of introducing the quantity of cross-linking promoting catalyst into the treating chamber by; supplying the catalyst in liquid form to the suction zone inlet of the pump and entraining the liquid catalyst into the treating steam at the suction zone of the pump; vaporizing the catalyst in the steam by using treating steam at a temperature above the vaporization temperature of the liquid catalyst; and delivering both the steam and vaporized catalyst to the treating chamber.

3. The method according to claim 2, wherein the steps of introducing the quantities of cross-linking agent and catalyst into the treating chamber are carried out by mixing liquid cross-linking agent and catalyst in liquid form together, supplying the mixture at the suction zone inlet of the pump, entraining and vaporizing the mixture in the treating steam at the suction zone of the pump, and introducing the treating steam and vaporized mixture simultaneously into the treating chamber.

4. The method according to claim 1, including the step of exposing the cellulosic material in the treating chamber to gaseous ammonia before cross-linking the cellulosic material.

5. The process according to claim 4, wherein the cellulosic material is exposed to the gaseous ammonia before it is exposed to the cross-linking agent.

6. A process according to claim 1, including introducing the cross-linking promoting catalyst in gaseous form into the chamber with the treating steam and cross-linking agent.

7. A process according to claim 6, wherein said cross-linking agent comprises formaldehyde.

8. A process according to claim 5, including introducing the cross-linking promoting catalyst into the chamber in gaseous form with the treating steam and cross-linking agent.

9. A process according to claim 8, wherein said cross-linking agent comprises formaldehyde.

10. The improvement in a method as claimed in claim 1, 2, 3 or 4 wherein said step of introducing and distributing steam and vaporized cross-linking agent throughout the treating chamber is effected by discharging same from an apertured portion of said conduit extending along the length of the treating chamber.

11. In a process for treating a fabric article containing a cellulosic material to provide controlled shrinkage during laundering and durable press properties for the fabric article including first exposing the fabric article in a treating chamber to a cellulosic material cross-linking agent and a cross-linking promoting catalyst, and then cross-linking the cellulosic material by heating the article, the improvement comprising: exposing the cellulosic material in the treating chamber to gaseous ammonia before cross-linking the cellulosic material.

12. The process according to claim 11, wherein exposing the cellulosic material to gaseous ammonia is carried out in the presence of steam.

13. The process according to claim 11 or 12, wherein the exposure of the cellulosic material to the ammonia is made before it is exposed to the cross-linking agent.

14. A process according to claim 13, wherein the cross-linking agent comprises formaldehyde.

15. A process for treating a fabric article containing a cellulosic material to provide controlled shrinkage during laundering and durable press properties for the fabric article comprising the steps of:

placing the fabric article in a treating chamber;

supplying a stream of treating steam and injecting a quantity of liquid cellulosic material cross-linking agent and a quantity of liquid cross-linking promoting catalyst directly into the stream of treating steam, said steam being supplied at a temperature above the vaporization temperature of the cross-linking agent and catalyst, said quantities of cross-linking agent and catalyst being selected to effect cross-linking of the cellulosic material in the treating chamber when the cellulosic material is heated to cellulosic material cross-linking temperature;

introducing a quantity of treating steam containing the vaporized liquid cellulosic material cross-linking agent and the vaporized catalyst into and throughout the chamber;

exposing the cellulosic material to the steam, vaporized cross-linking agent and vaporized catalyst for a time period and at a temperature that are appropriate to cause condensation of sufficient moisture, cross-linking agent and catalyst on the cellulosic material for carrying out cross-linking of the cellulosic material when it is heated to the cellulosic material cross-linking temperature;

venting the treating chamber to purge free steam, cross-linking agent and catalyst not retained on the cellulosic material;

heating the cellulosic material to the cellulosic material cross-linking temperature for a time sufficient to cross-link the cellulosic material; and cooling the treating chamber.

16. The process according to claim 15, including injecting a mixture of said liquid cellulosic material cross-linking agent and said liquid cross-linking promoting catalyst into said treating steam to produce said steam containing vaporized cellulosic cross-linking agent and cross-linking promoting catalyst.

17. A process according to claim 16, wherein the liquid cross-linking agent in said mixture comprises formaldehyde and the catalyst comprises magnesium chloride.

18. The method according to claim 15, including the step of exposing the cellulosic material article in the treating chamber to gaseous ammonia before cross-linking the cellulosic material.

19. The process according to claim 15, wherein the step of exposing the cellulosic material to the gaseous ammonia is carried out before it is exposed to the cross-linking agent.

20. A process as claimed in claim 15, wherein said step of introducing a quantity of treating steam containing the vaporized liquid cellulosic material cross-linking agent and the vaporized catalyst into the chamber is carried out via an apertured conduit extending along the length of the chamber.

* * * * *